US006539920B1

(12) United States Patent
Spiers

(10) Patent No.: US 6,539,920 B1
(45) Date of Patent: Apr. 1, 2003

(54) RETAINING CLIP

(75) Inventor: Dean Leigh Spiers, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 5 days.

(21) Appl. No.: 09/847,403

(22) Filed: May 3, 2001

Related U.S. Application Data

(60) Provisional application No. 60/201,825, filed on May 4, 2000.

(51) Int. Cl.[7] ..... F02M 55/02

(52) U.S. Cl. ..... 123/456; 123/469; 24/20 TT; 285/305; 285/921; 248/74.3

(58) Field of Search ..... 123/456, 468, 123/469, 470; 24/20 TT; 285/305, 319, 921, 351; 248/74.2, 74.3

(56) References Cited

U.S. PATENT DOCUMENTS

| | | | | | |
|---|---|---|---|---|---|
| 3,229,998 | A | | 1/1966 | Pennington | 285/419 |
| 3,233,907 | A | | 2/1966 | Stanton | 277/101 |
| 3,605,200 | A | * | 9/1971 | Vallinotto et al. | 24/20 TT |
| 3,913,187 | A | | 10/1975 | Okuda | 24/255 |
| 3,925,851 | A | | 12/1975 | Bevans | 24/20 |
| 4,093,282 | A | | 6/1978 | Kyriakodis | 285/114 |
| 4,183,120 | A | | 1/1980 | Thorne | 24/16 |
| 4,557,024 | A | | 12/1985 | Roberts et al. | 24/20 |
| 4,586,477 | A | * | 5/1986 | Field et al. | 123/468 |
| 4,763,695 | A | | 8/1988 | Dooley | 138/109 |
| 4,768,492 | A | * | 9/1988 | Widmer et al. | 123/41.31 |
| 4,935,992 | A | * | 6/1990 | Due | 24/16 R |
| 5,002,030 | A | * | 3/1991 | Mahnke | 123/456 |
| 5,024,405 | A | | 6/1991 | McGuire | 248/73 |
| 5,092,300 | A | * | 3/1992 | Imoehl et al. | 123/456 |
| 5,219,188 | A | * | 6/1993 | Abe et al. | 285/319 |
| 5,374,084 | A | * | 12/1994 | Potokar | 285/27 |
| 5,390,638 | A | * | 2/1995 | Hornby et al. | 123/456 |
| 5,405,175 | A | | 4/1995 | Bonnah, II et al. | 285/305 |
| 5,498,042 | A | | 3/1996 | Dole | 285/177 |
| 5,590,859 | A | | 1/1997 | Lord | 248/62 |
| 5,609,370 | A | * | 3/1997 | Szabo et al. | 285/319 |
| 5,735,555 | A | * | 4/1998 | Answine et al. | 285/319 |
| 5,772,258 | A | | 6/1998 | Dyer et al. | 285/114 |
| 5,842,450 | A | | 12/1998 | Fort et al. | 123/463 |
| 6,082,333 | A | * | 7/2000 | Vattelana et al. | 123/456 |

* cited by examiner

*Primary Examiner*—Henry C. Yuen
*Assistant Examiner*—Hai Huynh

(57) ABSTRACT

A clip to couple a crossover tube to a fuel rail includes an annular body that extends along a longitudinal axis between a first end and a second end of the clip, the first end capturing the crossover tube. The annular body includes a first arcuate portion coupled to a second arcuate portion and a tab. An arm extends from the other of the first and second arcuate portions, the arm having serrations extending generally towards the longitudinal axis. The annular body includes at least one catch surface located on at least the first and second arcuate portions. The catch surface is coupled to the at least one boss portion of the at least one fuel rail to couple the clip to the fuel rail. A method of coupling the clip to the crossover tube prior to the clip being secured to the fuel rail is also disclosed.

32 Claims, 4 Drawing Sheets

RETAINING CLIP

This application claims the benefits of provisional application Ser. No. 60/201,825 filed May 4, 2000.

BACKGROUND OF THE INVENTION

It is believed that examples of known fuel injection systems can use two or more fuel rails to deliver fuel to fuel injectors. Fuel is supplied to each fuel rail separately. The fuel pressure in one fuel rail is believed to vary relative to the other fuel rail. Such variation is believed to include fuel pressure spikes caused by the fuel injection pulses and other factors. It is believed that causing each fuel rail to fluidly communicate with the other fuel rails by a crossover tube can reduce fuel pressure spikes in each fuel rail.

The crossover tube is believed to be connected at one point to a mount on an engine and to the fuel rails by rigid connections. Leaks are believed to develop at the rigid connections due to powertrain vibrations or through repeated disassemblies of the fuel rail or the crossover tube.

It is believed that examples of known fuel injections systems that use such rigid connections have a number of disadvantages. Such examples are believed to restrict rotational movements between the fuel rail and the crossover tube.

It is believed that examples of known fuel injection systems use metal type fuel rails and elastomer type cross-over tubes. Such examples are believed to have a number of disadvantages including assembly processes that rely upon costly connectors, couplers or quick-connectors.

It is believed that other examples of known fuel injection systems require considerable rotational movement when connecting a cross-over tube to a fuel rail due to the limited amount of volume in an engine compartment of a vehicle. Such examples are believed to reduce manufacturing efficiency due to the need to ensure that the crossover tube is not twisted or pinched during assembly of the crossover tube and the fuel rail.

SUMMARY OF THE INVENTION

According to the present invention, a fuel rail system is provided for fuel injectors. The fuel rail system comprises at least one fuel rail having at least one boss portion disposed on at least one end of the at least one fuel rail, a cross-over tube proximate to the at least one fuel rail, the cross-over tube having a circumferential lip disposed proximate at least one end of the cross-over tube. A clip to couple the crossover tube to the at least one fuel rail. The clip cooperating with the lip to allow circumferential rotation of the crossover tube.

The present invention also provides for a retaining clip for use with a fuel rail. The retaining clip comprises an annular body extending along a longitudinal axis between a first end and a second end. The first end has an inner diameter different from the inner diameter of the second end. The annular body includes a first arcuate leg coupled to a second arcuate leg. A tab extends from one of the first and second arcuate legs at the first end, the tab having a plurality of serrations extending generally away from the longitudinal axis. An arm extends from the other of the first and second arcuate legs, the arm having another plurality of serrations extending generally towards the longitudinal axis. A cantilever arm extends over the tab, and at least one catch surface disposed on at least one of the first and second arcuate legs, the at least one catch surface located proximate the second end and extending generally between the first end and the second end.

The present invention further provides for a method of coupling and providing for relative rotation between a crossover tube and at least one fuel rail of a fuel injection system. The crossover tube having a circumferential lip at one end, the at least one fuel rail having at least one outwardly directed circumferential boss portion disposed at one end. The method comprises capturing the circumferential lip by a first arcuate and a second arcuate portions of an annular body, the first and second arcuate portions extending between a first end and a second end, coupling the first and second arcuate portions of the annular body by serrations located on the first and second arcuate portions; and securing the cross-over tube to at least one fuel rail by attachment of at least one projection of the annular body to the boss portion so that the crossover tube rotates relative to the at least one fuel rail.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENT

Figure 1A:
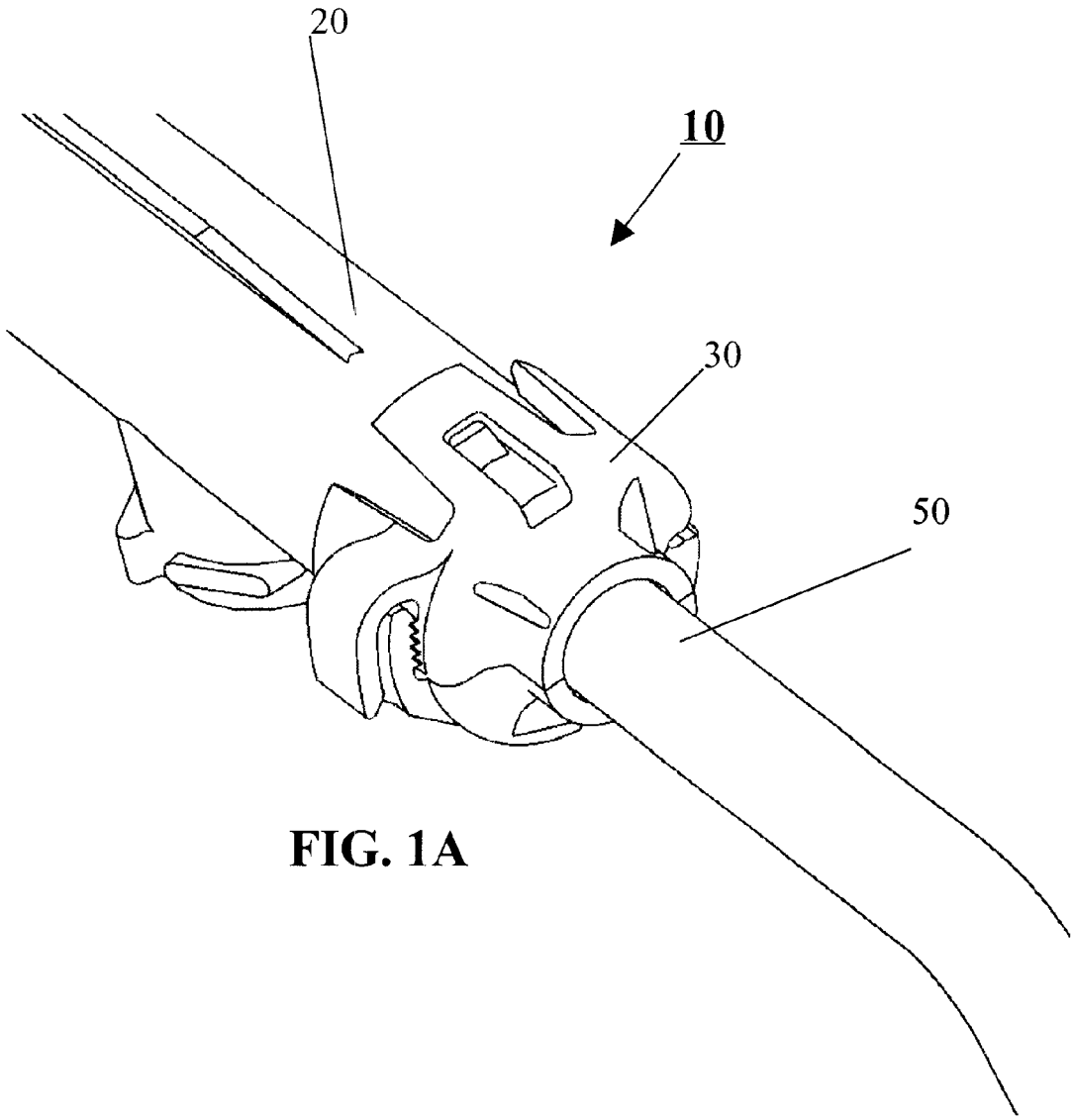
FIG. 1A is an orthogonal view of the fuel rail system.
Figure 1B:
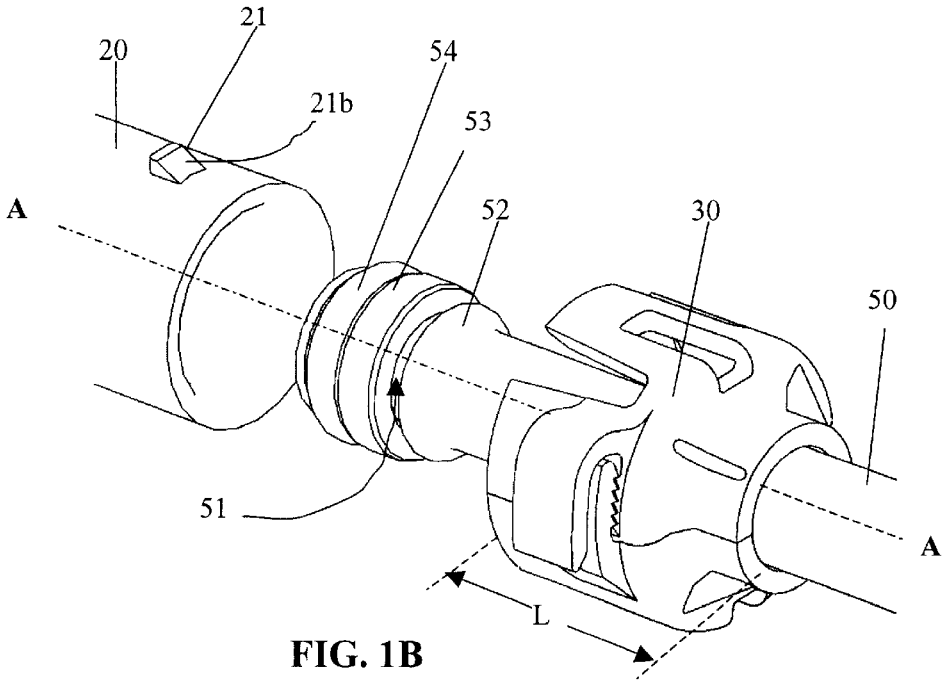
FIG. 1B is an exploded view of FIG. 1A from a different perspective.
Figure 1C:
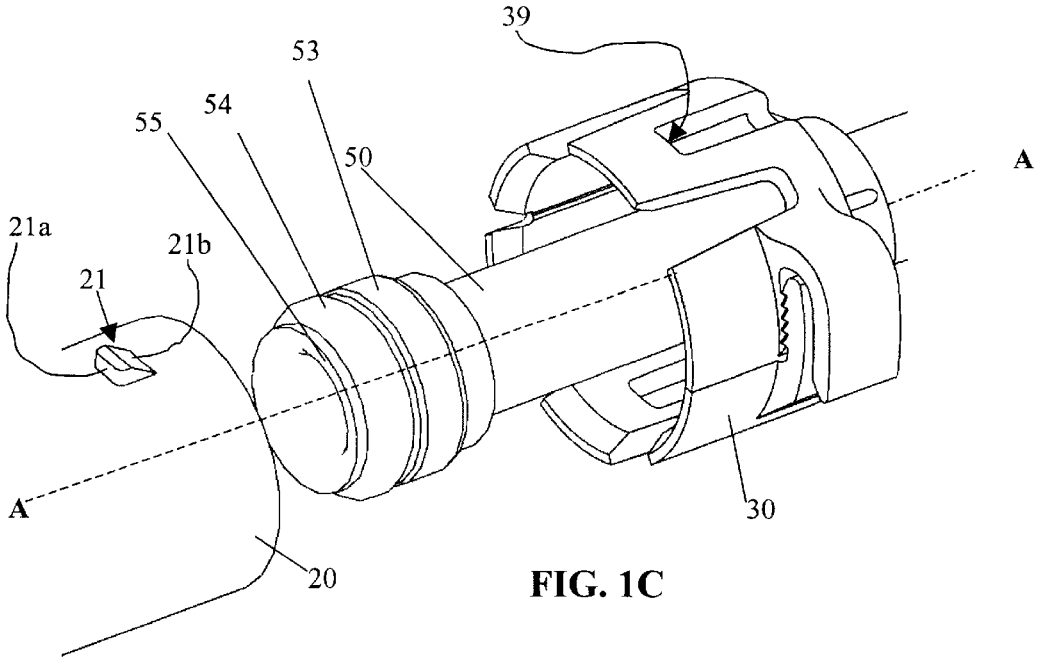
FIG. 1C is another exploded view of FIG. 1B from another perspective.

Referring to FIGS. 1A–1C, a fuel rail system 10 is shown. The system 10 includes a fuel rail 20, a device, also known as a clip or retainer, 30 that connects a crossover tube 50 to the fuel rail 20. The crossover tube 50 can be connected to another clip 30 to connect the fuel rail 20 to another fuel rail (not shown) in a multiple-rail fuel injection system (not shown). The fuel rail 20 supplies fuel to fuel injectors (not shown) mounted to an intake or a manifold (not shown) of the internal combustion chambers in an engine (not shown). Each of the fuel rail 20, clip 30 and crossover tube 50 can be molded or formed from a fuel-resistant and thermally-stable polymer composite. The polymer composite can be acetal copolymers, thermoplastic PBT polyesters, acrylonitrile/styrene/acrylate, acrylonitrile/butadiene/styrene, E-polyethersulfone, thermoplastic polyurethane elastomers, high-density polyethylene, polyetherimide, polyethylene sulfide, mineral reinforced nylon, nylons 6, 6/6, 6T or combinations thereof. It should be understood that other types of composite materials, polymer composites or combination of polymer composites could be employed so long as they suitable for the applicable environment. Preferably, the fuel rail 20 can be formed from 33% glass-filled PPS polymer, while the crossover tube 50 can be formed from mild steel with a rust-prevention coating or from stainless steel, and the clip 30 can be formed from nylon 6/6.

The fuel rail 20 has at least one boss portion 21 disposed on the circumferential surface of the fuel rail 20. The boss portion 21 is operative to engage with an element of the clip 30 to retain the clip 30 to the fuel rail 20. The crossover tube 50 includes at least one groove 51 on which a backup washer 53 can be mounted. The backup washer can be used to help support a seal 54, which is typically an o-ring. To help prevent the seal 54 from sliding off the crossover tube 50, at least one end of the crossover tube is a flared end 55. Similarly, a circumferential bead or lip 52 is formed some distance away from the terminus of the crossover tube to help retain the crossover tube to the clip 30. The circumferential bead or lip 52 cooperates with the clip 30 to retain the crossover tube 50 to the clip 30. The clip 30 includes an inner circumferential surface 41 (FIG. 2D) that allows the clip 30 to ride on the bead or lip 52 and also bears against the backup washer 53.

Figure 2A:
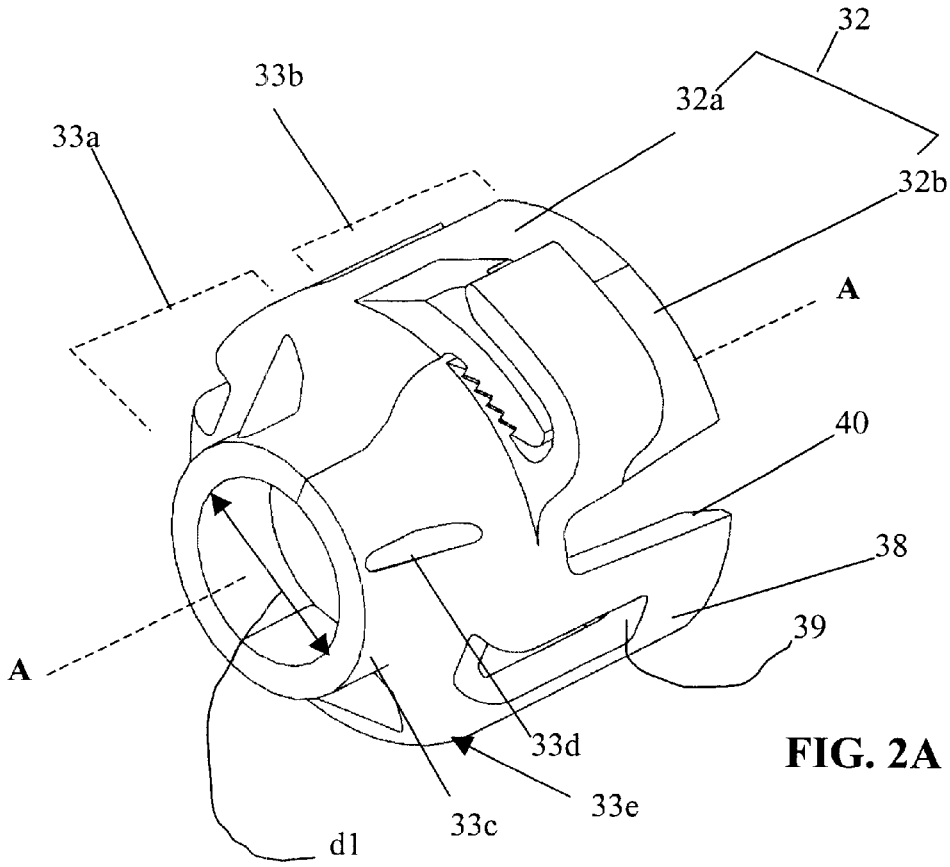
FIG. 2A is an isolated view of the clip used to retain the crossover tube to the fuel rail in the closed position.
Figure 2B:
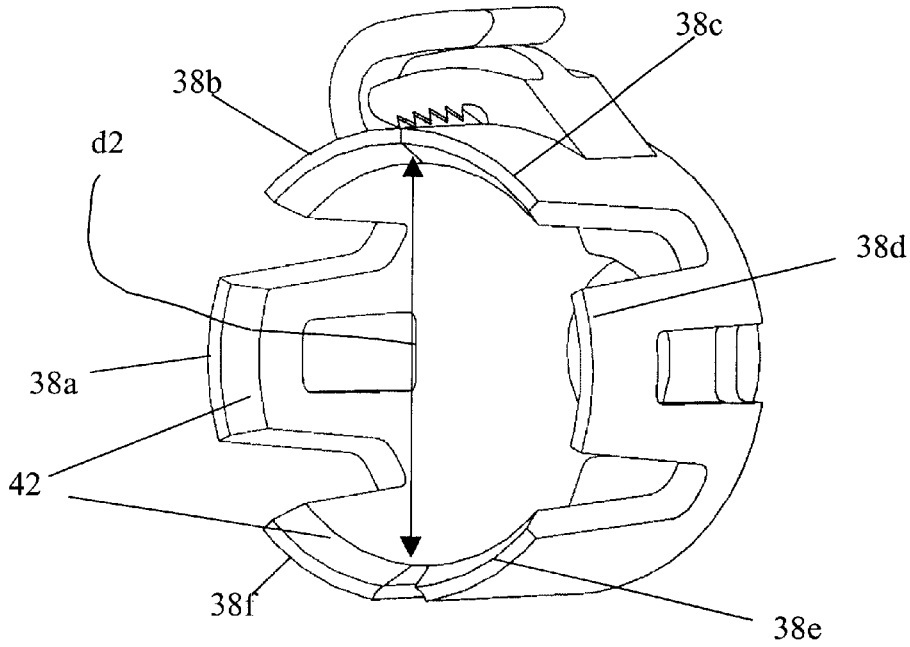
FIG. 2B is another view of the clip shown in FIG. 2A at a different perspective.
Figure 2C:
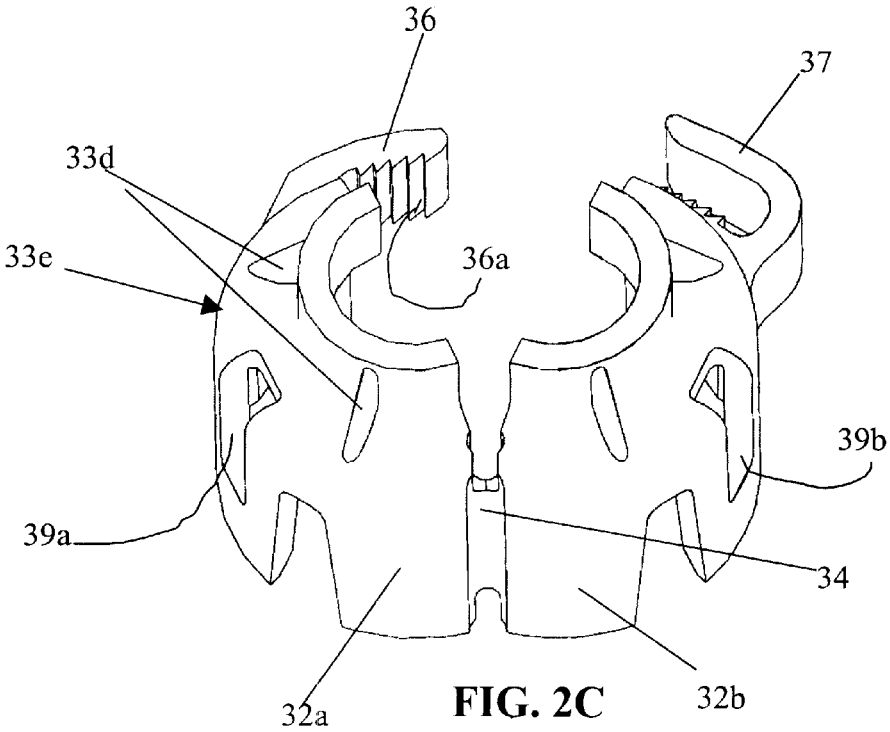
FIG. 2C is a view of the clip provided for use in a molded open position.
Figure 2D:
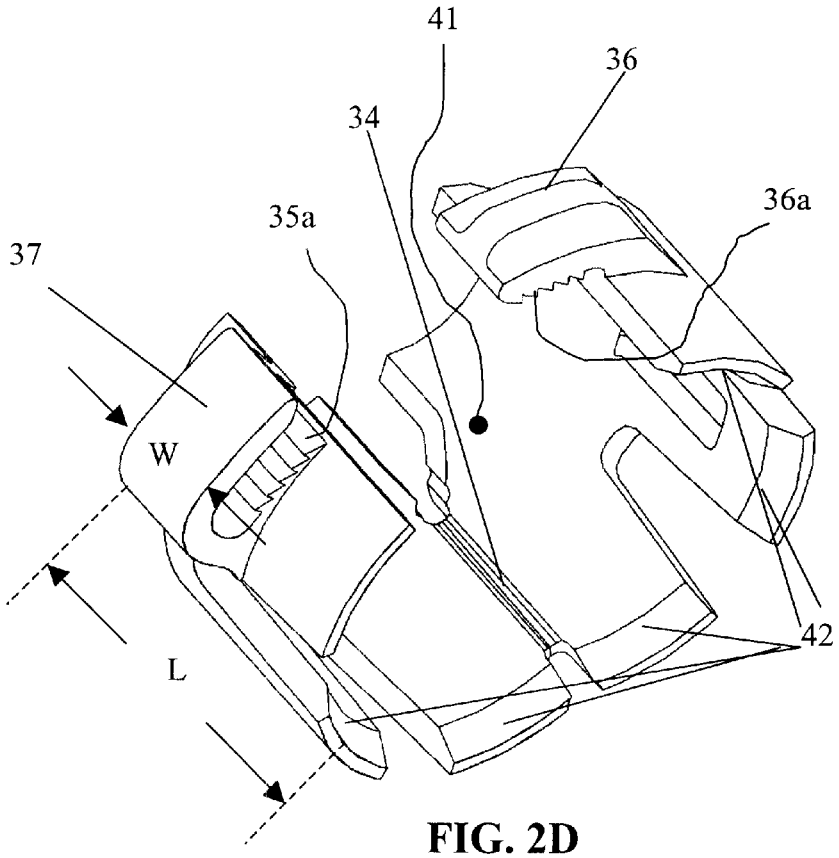
FIG. 2D is another view of FIG. 2C.

As seen in FIG. 2A, the clip 30, also known generally as a re-usable flexible retainer, is formed as a generally annular body 32 extending between longitudinal axis A—A. The annular body has a first end 33*a* and second end 33*b*. The annular body 32 can be formed out of two arcuate portion or legs 32*a* and 32*b* coupled together by a living hinge 34 (FIGS. 2C and 2D). The living hinge 34 can be formed as a longitudinally extending notch between the intersection of the two arcuate portions 32*a* and 32*b*.

Disposed near the first end 33*a* is a tab 35 having ratchet teeth or serrations 35*a* formed thereon. The ratchet teeth or serrations 35*a* include an apex on each serration that is orientated generally away from the longitudinal axis A—A. Similarly, an arm 36, disposed in a circumferential direction of the annular body 32, includes ratchet teeth or serrations 36*a* whose apexes are orientated generally towards the longitudinal axis A—A so as to form a locking configuration between the tab 35 and the arm 36. Preferably, the width "W" along the longitudinal axis of at least one of the tab 35 and arm 36 is less than one-half the length "L" of the annular body along the longitudinal axis. To ensure that the tab 35 and arm 36 remain locked together after the tube 50 is captured by the clip 30, a cantilever arm 37 can be used to prevent the ratchet teeth or serrations of the arm 36 from riding over the other ratchet teeth of the tab 35. Of course, the cantilever arm 37 can be manually moved so as to permit the unlocking and relocking of the arm 36 and the tab 35.

The first end 33*a* includes a generally cylindrical shaped portion 33*c* and a generally dome or truncated dome portion 33*e*. Disposed on an interior surface of the truncated dome portion is a surface 41 that is generally curved or angled relative to the longitudinal axis A—A. The portion 33*c* has a first inner diameter d1 that is different from a second inner diameter d2 of the second end. The second inner diameter d2 can be generally the same as the outside diameter of the fuel rail. The first inner diameter d1 is preferably smaller than the diameter of the circumferential lip 52 of the crossover tube. Preferably, the first inner diameter d1 is smaller than the second inner diameter d2, and the first inner diameter d1 should be substantially the same as the diameter of the crossover tube. Delta-shaped reinforcing ribs 33*d* can be formed on the circumferential surface of the generally cylindrical shaped portion 33*c* of the first end 33*a*. Rather than individual ribs, a single rib traversing the entire circumference of the cylinder portion 33*c* can be formed integral to the surface of the cylinder portion 33*c*.

Extending from approximately the first end 33*a* to the second end 33*b* along the longitudinal axis A—A is at least one projection 38. Preferably, six projections (38*a*, 38*b*, 38*c*, 38*d*, 38*e* and 38*f*) are diametrically located on the annular body 32. A catch surface 39 (FIGS. 2C and 2D) can be formed on the inner surface of at least one of the projections. Preferably, two catch surfaces 39 can be located on two diametrically disposed projections 38*a* and 38*d*. The catch surface 39 engages a boss portion formed on circumferential surface of the fuel rail 20. Although shown as part of a through-opening, the catch surface 39 can be covered on the outer circumferential surface of the clip 30 so as to present a smooth and uninterrupted outer surface while still having a catch surface on the inner circumferential surface of the clip 30 to permit engagement with the boss portion of the fuel rail 20. The through-opening provides for the fuel system to be visually inspected during or after assembly to ensure that the catch surfaces engage the boss portions.

Disposed on each side of the projection 38 are cutouts 40. The cutouts 40 are believed to allow some flexibility to the projection 38 relative to the longitudinal axis A—A, while still permitting the projection 38 to conform to, and in certain applications, grip the outer surface of the fuel rail. A ramp 42 is formed on each end of the projection 38 at the second end to allow the projection 38 to engage the boss portion. The boss portion of the fuel rail 20 can be of any suitable shape, including a rectangular block, hook or, for example, a right-angle pyramidal ramp 21 (FIGS. 1A and 1B) having a generally vertical abutment surface 21*a* and an angled ramping surface 21*b*. In the case of a right-angle pyramidal ramp 21, the generally vertical abutment surface 21*a* engages with the catch surface 39 to prevent rotation of clip 30 about axis A—A, and longitudinal movement of the clip 30 away from the fuel rail 20.

The clip 30 is utilized as follows. Initially, the clip 30 is provided in an "open" position. The "open" position means that that the ratchets or serrations do not connect the two arcuate portions or legs of the clip 30. In a preferred embodiment, the clip 30 is molded so that the two arcuate portions or legs are disposed about the living hinge, as shown in FIGS. 2C and 2D. While the clip 30 is in the open position, the first end 33*a* is orientated on the crossover tube 50 such that the lip 52 or bead is forward of the first end 33*a* but behind the backup washer 53. The clip 30 is then placed in a "closed" position (FIG. 1B) to allow the crossover tube 50 to be captured while also supporting the clip 30 on the bead or lip 52. It should be noted that the "closed" position means that the tab 35 and the arm 36 are locked via the respective ratchet teeth or serrations. The clip 30 and its projections 38 are aligned with the boss or ramp surface 21*b* of the fuel rail. The clip 30, along with the tube 50, is slid along the longitudinal axis of the fuel rail to couple the clip 30 to the fuel rail 20.

As the clip 30 approaches the ramp surface 21*b*, the corresponding ramps 42 on the projections 38 of the clip 30 engages the ramp surface 21*b*. When the catch surfaces 39 are substantially aligned, each projection 38 rides over the apex of the ramp 21 as the clip 30 moves relative to the fuel rail 20. Once the clip 30 has been inserted a set distance, the catch surfaces 39 engage with the generally vertical surface 21*a* to lock the clip 30 along with the cross-over tube 50 to the fuel rail 20. The set distance is believed to be the distance necessary to ensure that the seals on the crossover tube 50 engages the inner diameter of the fuel rail 20, such that there is substantially no leak therebetween.

Because the inner diameter of the first end 33*a* is generally the same as the outer diameter of the crossover tube 50 while being smaller than the outer diameter of the lip 52 or bead, the first end 33*a* permits relative rotation between the crossover tube 50 and the fuel rail 20. Such capability is believed to allow the crossover tube 50 and the fuel rail 20 to tolerate rotational misalignment or twisting during installation and servicing of the fuel rail or the fuel injection system. Because the inner surface 41 can be generally curved or angled relative to the longitudinal axis, it can prevent excessive movement of the crossover tube 50 or backup washer 53 relative to the clip 30.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. A fuel rail system for use with fuel injectors, the system comprising:

at least one fuel rail having at least one boss portion disposed on at least one end of the at least one fuel rail;

a cross-over tube proximate to the at least one fuel rail, the cross-over tube having a circumferential lip disposed proximate at least one end of the cross-over tube;

a clip to couple the cross-over tube to the at least one fuel rail, and cooperating with the lip to allow circumferential rotation of the crossover tube, wherein the clip further comprises:

a first arcuate leg coupled to a second arcuate leg;

a tab extending from one of the first and second arcuate legs at the first end, the tab having a plurality of serrations extending generally away from the longitudinal axis;

an arm extending from the other of the first and second arcuate legs, the arm having another plurality of serrations extending generally towards the longitudinal axis;

a cantilever arm extending over the tab; and at least one catch surface disposed on at least one of the first and second arcuate legs and extending generally between the first end and the second end, the catch surface configured to receive the at least one boss portion.

2. The fuel rail system as claimed in claim 1, wherein the crossover tube further comprises at least one seal disposed between the cross-over tube and the at least one fuel rail.

3. The fuel rail system as claimed in claim 2, wherein the at least one seal comprises an o-ring.

4. The fuel rail system as claimed in claim 2, wherein the diameter of the circumferential lip is greater than the diameter of the first end.

5. The fuel rail system as claimed in claim 1, further comprising a living hinge coupled to the first and second arcuate legs.

6. The fuel rail system as claimed in claim 1, wherein the first end is generally dome-shaped.

7. The fuel rail system as claimed in claim 1, wherein a width of at least one of the arm and tab is less than one-half of the distance of the annular body along the longitudinal axis between the first and second ends.

8. The fuel rail system as claimed in claim 1, wherein the boss portion further comprises at least one right-angle pyramidal portion formed on the at least one fuel rail.

9. The fuel rail system of claim 1, wherein the first and second arcuate legs defines a first portion spaced from a second portion along a longitudinal axis, the first portion having a first diameter less than a second diameter of the second portion.

10. The fuel rail system of claim 9, wherein the first diameter is less than a diameter of the lip of the cross-over tube and the second diameter comprises a diameter substantially equal to a diameter of the fuel rail.

11. A retaining clip for use with a fuel rail, the retaining clip comprising:

an annular body extending along a longitudinal axis between a first end and a second end, the first end having an inner diameter different from the inner diameter of the second end, the annular body including a first arcuate leg coupled to a second arcuate leg;

a tab extending from one of the first and second arcuate legs at the first end, the tab having a plurality of serrations extending generally away from the longitudinal axis;

an arm extending from the other of the first and second arcuate legs, the arm having another plurality of serrations extending generally towards the longitudinal axis;

a cantilever arm extending over the tab; and at least one catch surface disposed on at least one of the first and second arcuate legs, the at least one catch surface located proximate the second end, and extending generally between the first end and the second end.

12. The retaining clip as claimed in claim 11, further comprising a living hinge coupled to the first and second arcuate legs.

13. The retaining clip as claimed in claim 11, wherein a portion of the first end comprises a generally cylindrical end.

14. The retaining clip as claimed in claim 11, wherein a portion of the first end comprises a truncated dome having a generally curved interior surface.

15. The retaining clip as claimed in claim 11, wherein a width along the longitudinal axis of at least one of the tab and arm is less than one-half the length of the annular body along the longitudinal axis between the first end and second end.

16. The retaining clip as claimed in claim 11, wherein the second end includes at least one open ended slot to enable the at least one catch surface to deflect relative to the longitudinal axis.

17. The retaining clip of claim 11, wherein the inner diameter of the first end comprises a first diameter less than the inner diameter of the second end, the first end being adapted to prevent axial movement and permit rotational movement of a fuel cross-over tube relative to the longitudinal axis.

18. The retaining clip of claim 11, wherein the inner diameter of the second end of the annular body of the retaining clip comprises a second diameter, the second end being adapted to prevent axial and rotational movements of the annular body relative to a fuel rail.

19. A method of coupling and providing for relative rotation between a cross-over tube and at least one fuel rail of a fuel injection system, the cross-over tube having a circumferential lip at one end, the at least one fuel rail having at least one boss portion disposed at one end, the method comprising:

capturing the circumferential lip by a first arcuate and a second arcuate portions of an annular body, the first and second arcuate portions extending between a first end and a second end;

coupling the first and second arcuate portions of the annular body by serrations located on the first and second arcuate portions; and securing the cross-over tube to at least one fuel rail by attachment of at least one projection of the annular body to the boss portion so that the crossover tube rotates relative to the at least one fuel rail.

20. The method as claimed in claim 19, wherein the capturing further comprises rotating the first and second arcuate portions about a living hinge.

21. The method as claimed in claim 20, wherein the annular body further comprises at least one longitudinally extending notch contiguous to the first and second arcuate portions.

22. The method as claimed in claim 19, wherein the capturing further comprises engaging a truncated dome with a lip.

23. The method as claimed in claim 19, wherein the capturing further comprises supporting the clip by the lip of the crossover tube.

24. The method of claim 19, wherein the capturing comprises retaining the circumferential lip of the cross-over tube with a first portion of the annular body having a diameter less than the diameter being defined by the circumferential lip.

25. The method of claim 24, wherein the retaining comprises permitting rotation of the cross-over tube relative to the first portion entirely about a longitudinal axis of the cross-over tube prior to the securing of the cross-over tube to the at least one fuel rail.

26. The method of claim 19, wherein the securing comprises retaining the boss portion of the fuel rail with a second portion of the annular body having a diameter substantially equal to the diameter of the fuel rail.

27. The method of claim 26, wherein the securing comprises preventing rotation of the annular body relative to the fuel rail.

28. A fuel rail system for use with fuel injectors, the system comprising:

at least one fuel rail having at least one boss portion disposed on at least one end of the fuel rail;

a cross-over tube proximate to the at least one fuel rail, the cross-over tube having a circumferential lip disposed proximate at least one end of the cross-over tube;

a clip having an annular body extending along a longitudinal axis between a first end and a second end, the first end having a first inner diameter different from a second inner diameter of the second end, the annular body including a first arcuate leg being coupled to a second arcuate leg so that the cross-over tube is rotatable about the longitudinal axis relative to the clip.

29. The fuel rail system of claim 28, wherein the clip comprises a living hinge pivotably coupling the first arcuate leg to the second arcuate leg at respective contiguous ends of the arcuate legs.

30. The fuel rail system of claim 29, wherein the clip comprises a respective locking arm and tab being formed on respective portions of the arcuate legs distal to the contiguous ends of the arcuate legs so as to lock the arcuate legs together.

31. A retaining clip for use with a fuel rail and a cross-over tube, the retaining clip comprising:

an annular body extending along a longitudinal axis between a first end and a second end, the first end having a first inner diameter different from a second inner diameter of the second end, the annular body including a first arcuate leg and a second arcuate leg being disposed about the longitudinal axis; and a living hinge pivotably coupling the first arcuate leg to the second arcuate leg at respective contiguous ends of the arcuate legs so that when the first arcuate leg is connected to the second arcuate leg at respective distal ends of the arcuate legs, the first end is adapted to retain the cross-over tube and adapted to permit relative rotation between the first end and the cross-over tube.

32. The retaining clip of claim 31, further comprising a respective locking arm and tab being formed on respective portions of the arcuate legs distal to the contiguous ends of the arcuate legs so as to lock the arcuate legs together.

* * * * *